United States Patent [19]

Lindberg

[11] Patent Number: 4,989,494

[45] Date of Patent: Feb. 5, 1991

[54] FEED DEVICE INCORPORATED IN A TANK

[75] Inventor: Sven Lindberg, Degerfors, Sweden

[73] Assignee: Aktiebolaget Bofors, Bofors, Sweden

[21] Appl. No.: 420,429

[22] Filed: Oct. 12, 1989

[30] Foreign Application Priority Data

Oct. 12, 1988 [SE] Sweden ..... 8803615-7

[51] Int. Cl.[5] ..... F41A 9/42

[52] U.S. Cl. ..... 89/46; 89/47

[58] Field of Search ..... 89/45, 46, 47, 36.08

[56] References Cited

U.S. PATENT DOCUMENTS

| | | | |
|---|---|---|---|
| 1,304,583 | 5/1919 | McClain | 89/46 |
| 3,238,845 | 3/1966 | Christiansson | 89/46 |
| 3,501,996 | 3/1970 | Lipp et al. | 89/34 |
| 3,700,395 | 10/1972 | Brint | 89/45 |
| 4,313,363 | 2/1982 | Schreckenberg | 89/46 |
| 4,329,909 | 5/1982 | Tidstrom | 89/46 |
| 4,429,616 | 2/1984 | Grosser | 89/46 |
| 4,852,461 | 8/1989 | Von Laar et al. | 89/46 |

FOREIGN PATENT DOCUMENTS

| | | | |
|---|---|---|---|
| 711874 | 9/1941 | Fed. Rep. of Germany | 89/46 |
| 1959548 | 6/1971 | Fed. Rep. of Germany | 89/36.08 |
| 314927 | 10/1969 | Sweden | 89/34 |
| 772463 | 4/1957 | United Kingdom | 89/36.08 |
| 2153496 | 8/1985 | United Kingdom | 89/46 |

*Primary Examiner*—Charles T. Jordan
*Assistant Examiner*—Stephen Johnson
*Attorney, Agent, or Firm*—Pollock, Vande Sande & Priddy

[57] ABSTRACT

A tank (1) is designed with an overlying gun (3) and a crew turret (2). The traverse movements of the gun and the crew turret are coordinated. A complete ammunition handling system (9, 11) for reserve ammunition (10) is provided ancillary to the standard feeding and loading system. The reserve system includes an ammunition tube which is guided by a linkage system (9) between a rest position and a position in an extension of the bore axis (5). The ammunition tube is provided with its own ramming means (11*a*). At a predetermined traverse position for the gun and the crew turret, reserve ammunition may be transferred to the system when this assumes an initial position. The reserve system may be actuated in a per se known manner so that the ammunition tube assumes a position in association with the breech, where the ammunition unit may be longitudinally displaced into the gun with the aid of the above-mentioned ramming means (11*a*).

9 Claims, 1 Drawing Sheet

FEED DEVICE INCORPORATED IN A TANK

TECHNICAL FIELD

The present invention relates to a feed device, incorporated in a tank, for ammunition units (rounds), in which the tank is designed with an overlying gun and includes a crew turret revolvingly disposed with the gun.

BACKGROUND ART

Ammunition handling systems employed in connection with tanks are previously well known in this art. As a rule, the available space in the tank is limited, which places extreme technical demands on the ammunition handling which must be effected rapidly and reliably. On occasions, the ammunition feed system in the tank may break down, which may give rise to a tactically difficult situation. Most often, one or a few rounds should be sufficient to "shoot through" or withdraw from a given combat situation.

TECHNICAL PROBLEM

It is a important to ensure that the tank would be capable, at any moment, to fire a round even if the ammunition handling system inside the tank were to break down. The present invention relates specifically to this problem. The novel apparatus according to the present invention includes a feed device forming a complete ammunition handling system for reserve ammunition ancillary to a standard forward-feeding and loading system. The ammunition handling system comprises a carrier unit (ammunition canister or tube) for each respective reserve ammunition unit, the carrier unit being controllable by a linkage system and being provided with its own ramming means; that the carrier unit (the ammunition tube) is, in a rest position, placed by the linkage system in association with an aperture provided in the crew turret, through which aperture the reserve ammunition unit may be manually inserted into the carrier unit. The linkage system may be controlled such that the reserve ammunition unit is movable through a closable aperture in the upper side of the tank up to a position at the breech of the gun in an extension of the bore axis, wherein the reserve ammunition unit may be moved to the ramming position with the aid of the above-mentioned ramming means.

In further developments of the inventive concept as herein disclosed, the ammunition handling system is to be located in a space in immediate association to and behind the crew turret. One or more reserve ammunition units (rounds) are disposed to be retrievable through a second aperture in the crew turret for manual transfer to the carrier unit (the ammunition tube) through the first aperture.

In one preferred embodiment, the complete ammunition handling system is interactable with the breech of the gun only at a predetermined traverse position and predetermined elevation of the gun.

The further developments also take into account the design of the linkage system. Hence, the linkage system is to include two substantially parallel rods which are held together at their middle regions by a crosspiece which is movably carried in the rods at its ends. The first rod displays a lower, positionally fixed first journal and is, at its upper end, displaceable in a longitudinal guide (recess) in the carrier unit (the ammunition tube). The second rod is pivotally anchored in the carrier unit by means of its upper end, while its other end is displaceably arranged with a cylinder or the like. This cylinder may be carried in the positionally fixed journal for the first rod. When the piston rod is protracted out of the cylinder, the above-mentioned rods are shifted apart in parallel, implying that the carrier device/the ammunition tube is raised. Lowering of the carrier device is effected by retraction of the piston rod.

The novel arrangement according to the present invention as proposed in the foregoing provides a simple and space-saving design of the reserve ammunition supply system. This may be disposed in a space above reserve ammunition behind the crew turret and will, by such means, be readily accessible through apertures in the crew turret to a loader who can pull out the round from the reserve magazine and insert it in the ammunition tube. Controlling (hoisting) may readily be effected automatically and/or manually and the ramming movement when the ammunition tube finally assumes its position in an extension of the bore access can be controlled in a simple manner, automatically and/or manually.

BRIEF DESCRIPTION OF THE ACCOMPANYING DRAWINGS

The nature of the present invention and its aspects will be more readily understood from the following brief description of the accompanying Drawings, and discussion relating thereto of one currently proposed embodiment of the present invention displaying the characterizing features of the novel reserve feed system.

In the accompanying Drawings:

FIG. 1 shows, in cross section, parts of a tank utilizing the novel reserve feed system, this figure showing the system in a rest or initial position; and FIG. 2 shows, in vertical section, the parts of FIG. 1, but with the reserve feed system in the ramming position in the overlying gun.

DESCRIPTION OF PREFERRED EMBODIMENT

Figure 2:
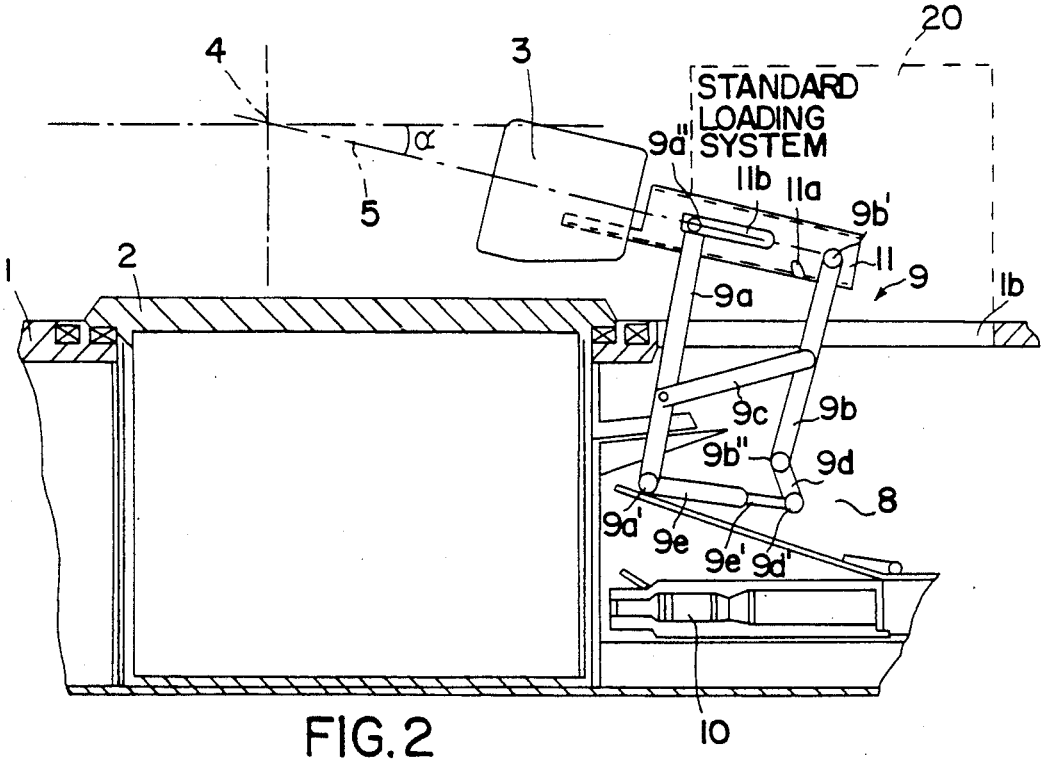
Figure 1:
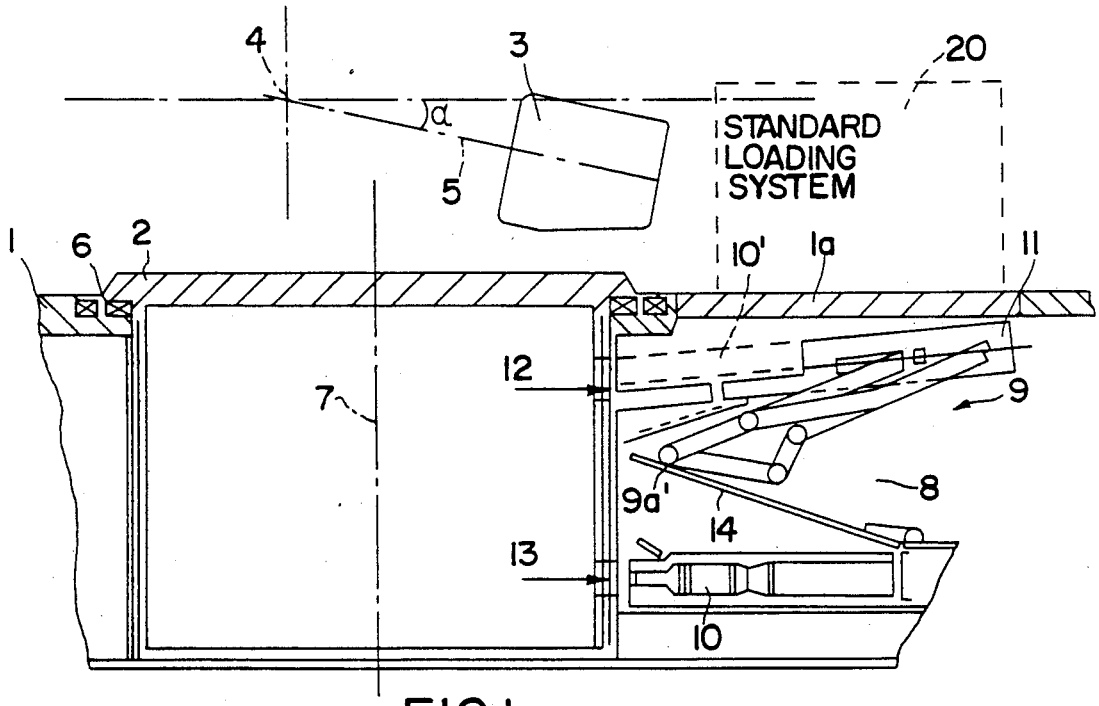

Referring to the Drawings, a tank is represented in FIGS. 1 and 2 by parts of its chassis 1, a crew turret 2 revolvingly disposed in the chassis and parts of an overlying gun 3 whose breech block is primarily illustrated. The journalling of the gun is indicated by reference numeral 4 and the bore axis by reference numeral 5. The angle of elevation of the gun is shown by the symbol $\alpha$. The crew turret is revolvable in a journal 6 about a center axis 7.

Behind the crew turret, the tank is provided with a space 8. In the space, there is disposed a complete reserve ammunition handling system 9 for reserve ammunition 10 which is provided in addition to a standard ammunition system 20. In FIG. 1, the system assumes its rest position or initial position and, in FIG. 2, its ramming position. In the rest position, a carrier unit/ammunition tube 11 included in the system is registered with a first aperture in the crew turret, this aperture being indicated by means of an arrow 12. Correspondingly, a reserve round 10 is in register with a second aperture indicated by means of an arrow 13. In the present case, it is presupposed that loading with the complete reserve ammunition handling system may only take place in a predetermined traverse position and at a predetermined elevation of the gun. The crew turret follows the traversing movement of the gun and the apertures 12 and 13 are open in the predetermined traverse position.

When the turret and the gun assume the predetermined traverse position, it is thus possible for a crew member to transfer the reserve round from its place in the space 8 to its place 10' in the ammunition tube 11. The reserve round and the reserve ammunition handling system are separated by an inclined wall 14. When the ammunition unit 10 is transferred to its position 10' in the ammunition tube, the ammunition handling system may be actuated to the ramming position in accordance with FIG. 2, the ammunition tube 11 with the inserted round 10' passing through an aperture 1*b* in the upper side of the tank. Normally, the aperture 1*b* is covered by a hatch 1*a*.

When the ammunition tube with the inserted round has been moved to the ramming position, the ramming means 11*a* may be actuated so that the ammunition unit placed in the extension of the bore axis 5 by the ammunition tube 11 may be longitudinally displaced into the breech.

The linkage system comprises two rods 9*a* and 9*b* operating substantially in parallel and interconnected at their middle regions by a crosspiece 9*c* which, at its ends, is rotatably carried in the rods 9*a* and 9*b*. The rod 9*a* is provided with a positionally fixed first journal 9*a'*. The other end 9*a''* of the rod is displaceably disposed in a longitudinal recess 11*b* in the ammunition tube. The second rod 9*b* is rotatably journalled, at its first end 9*b'*, in the ammunition tube. At its other end 9*b''*, the rod is connected, through a rotary journal, to a further arm 9*d*. A hydraulic cylinder 9*e* is carried in the journal 9*a'* at its one end, while its piston rod 9*e'* is carried in the end 9*d'* of the arm 9*d*.

In FIG. 1, the piston rod 9*e'* is retracted in the cylinder 9*e*, implying that the journal 9*a''* has assumed its one end position in the recess 11*b*. The entire linkage system has thereby folded together about the journal 9*a'*, and the ammunition tube may assume a lowered position. When the piston rod 9*e'* is urged outwardly, the journal 9*a''* is forced to execute a longitudinal displacement movement in the recess 11*b*, entailing that the linkage system rises and lifts the ammunition tube to the position illustrated in FIG. 2.

In the Figures, only a single set of linkages has been shown for hoisting the carrier unit/the ammunition tube 11. A corresponding set of linkages is disposed on the other side of the carrier unit/the ammunition tube. This second set of linkages is of the same appearance and function as described above. One or two cylinders 9*e* may be employed and, when only one cylinder is used, transverse connections are required between the linkage sets, seen in the receding direction of the flat plane of the Drawing. Operation of the cylinder/cylinders 9*e* may be effected manually with the aid of pump devices (not shown in detail) and/or automatically using a known control system. Similarly, the ramming means 11*a* may be actuated manually and/or automatically in a known manner. Manual actuation is effected by means of links, chains, and the like. (not shown), while the automatic control may may be effected with the aid of hydraulic transmission (not shown).

The present invention should not be considered as restricted to the embodiment described above and shown on the Drawings by way of example, many modifications being conceivable without departing from the spirit and scope of the appended Claims and inventive concept as herein disclosed.

What we claim and desire to secure by Letters Patent is:

1. In a tank having an overlying gun, a crew turret adapted to follow movements of the gun, and an ammunition loading system, a reserve ammunition loading system for reserve ammunition units comprising:

an ammunition carrier tube for carrying at least one reserve ammunition unit, said ammunition carrier tube being provided with reserve ramming means, said ammunition carrier tube being movable between a rest position and a ramming position;

a linkage system displaceable between a folded and an unfolded position for supporting and carrying said ammunition carrier tube between said rest and ramming positions, respectively;

first and second apertures provided in a wall of the crew turret and being spaced apart;

said ammunition carrier tube in said rest position being in communication with said first aperture and said at least one reserve ammunition unit being in communication with said second aperture and accessible to a crew member for withdrawing said reserve ammunition unit through said second aperture and transferring said reserve ammunition unit through said first aperture into said ammunition carrier tube; and said ammunition carrier tube with said reserve ammunition unit being movable by said linkage system through a closeable opening in a wall of the tank to a position at the breach of the gun from which said reserve ammunition unit is insertable into said breach of the gun by said reserve ramming means.

2. The device as claimed in claim 1, wherein said reserve ammunition loading system is located in a space directly behind the crew turret.

3. The device as claimed in claim 2, wherein said linkage system includes a first and a second rod which are disposed substantially in parallel and interconnected at their middle regions by a crosspiece which is movably journalled in said rods; said first rod having a positionally fixed first journal at the lower end and, at the upper end, is displaceable in a longitudinal recess provided in said reserve ammunition carrier tube; and wherein said second rod is pivotally mounted on said reserve ammunition carrier tube at the upper end, and at the other end is displaceable by a hydraulic piston movable in a cylinder.

4. The device as claimed in claim 1, wherein said reserve ammunition loading system is interactable with the breech of the gun only in a predetermined traverse position and at a predetermined elevation of the gun.

5. The device as claimed in claim 1, wherein said linkage system includes a first and a second rod which are disposed substantially in parallel and interconnected at their middle regions by a crosspiece which is movably journalled in said rods; said first rod having a positionally fixed first journal at the lower end and, at the upper end, is displaceable in a longitudinal recess provided in said reserve ammunition carrier tube; and wherein said second rod is pivotally mounted on said reserve ammunition carrier tube at the upper end, and at the other end is displaceable by a hydraulic piston movable in a cylinder.

6. The device as claimed in claim 5, wherein the movement for the reserve ammunition carrier tube is effected by means of said piston movable in said cylinder.

7. The device as claimed in claim 6, wherein said second rod in interconnected with a third rod, said third having one end connected to a rod of said hydraulic piston; and wherein said cylinder is secured to said positionally fixed first journal.

8. The device as claimed in claim 5, wherein said second rod is interconnected with a third rod, said third rod having one end connected to a rod of said hydraulic piston; and wherein said cylinder is secured to said positionally fixed first journal.

9. The device as claimed in claim 5, wherein said reserve ammunition loading system is interactable with the breech of the gun only in a predetermined traverse position and at a predetermined elevation of the gun.

* * * * *